US006504121B2

(12) United States Patent
Hasunuma

(10) Patent No.: US 6,504,121 B2
(45) Date of Patent: Jan. 7, 2003

(54) KEYBOARD SWITCH HAVING LEG DISLODGEMENT PREVENTING MECHANISM

(75) Inventor: Seigo Hasunuma, Gunma (JP)

(73) Assignee: Hosiden Corporation, Osaka (JP)

( * ) Notice: Subject to any disclaimer, the term of this patent is extended or adjusted under 35 U.S.C. 154(b) by 36 days.

(21) Appl. No.: 09/861,000

(22) Filed: May 17, 2001

(65) Prior Publication Data

US 2001/0046402 A1 Nov. 29, 2001

(30) Foreign Application Priority Data

May 18, 2000 (JP) ..... 2000-146241

(51) Int. Cl.[7] ..... B41J 5/16
(52) U.S. Cl. ..... 200/344; 400/490; 400/495
(58) Field of Search ..... 400/490, 495, 400/495.1, 496, 472; 200/344

(56) References Cited

U.S. PATENT DOCUMENTS 5,758,763 A * 6/1998 Sanda et al. ..... 200/344
6,068,416 A * 5/2000 Kumamoto et al. ..... 200/344
6,183,150 B1 * 2/2001 Kao ..... 200/344

* cited by examiner

*Primary Examiner*—Leslie J. Evanisko
*Assistant Examiner*—Jill E. Culler
(74) *Attorney, Agent, or Firm*—David N. Lathrop, Esq.; Gallagher & Lathrop

(57) ABSTRACT

In a keyboard switch including a pantograph mechanism comprising a U-shaped link 14 having a pair of stud shafts 14C rotatably and movably supported in bearing portions 13B of a base 13 and a link 15 including a frame-like portion 15A and having a pair of stud shafts 15D rotatably supported in bearing portions 13C ofthe base 13, ribs 14F having tapered surfaces 14G are provided along the peripheral surfaces of bosses 14D defining the center of rotation of the link 14 while holes 15E in the link 15 for mating with the bosses 14D are formed with keyways 15F. When a force tending to pull the keytop up further from it returned original position is applied to the keytop, the tapered surfaces 14G and the angular edges of the keyways 15F are forced into contact with each other. This urging force in turn urges the opposed legs 14B of the link 14 to expand apart from each other in the directions indicated by the arrows 19, whereby the link 14 is prevented from dislodging from the base 13.

8 Claims, 13 Drawing Sheets

KEYBOARD SWITCH HAVING LEG DISLODGEMENT PREVENTING MECHANISM

BACKGROUND OF THE INVENTION

This invention relates to a keyboard switch suitable for use with various kinds of equipment such as personal computers, word processors, and the like, and particularly to a keyboard switch having keytops configured to be supported by means of pantograph mechanisms.

FIG. 1 illustrates an example of the heretofore proposed keyboard switch having such configuration in which on a plate 11 made of a metal plate, for example there is disposed a membrane sheet (contact sheet) 12 on which a base 13 made of a metal plate is positioned. The membrane sheet (contact sheet) 12 comprises,a pair of laminated contact layers 12B and 12C spaced apart by a spacer 12A, and a movable contact pattern and a pair of fixed contact patterns (not shown) formed on the opposed surfaces of the contact layers 12B and 12C, respectively, the arrangement being such that the contact layer 12B is adapted, when depressed toward the contact layer 12C, to bring the movable contact pattern into contact with the pair of fixed contact patterns. It is to be noted that there are a plurality of the sets of the movable contact pattern and the fixed contact patterns are provided so that any selected one of the sets may be actuated to make contact.

As shown in FIG. 2, the base 13 has generally square openings 13A formed therethrough, each for one of the sets of contact patterns, and is formed with a pair of first journal bearing portions 13B and a pair of second journal bearing portions 13C projecting oppositely from the membrane sheet 12 along the two opposed side edges of each opening 13A. The pair of first journal bearing portions 13B are opposed to each other and are formed in the form of a protrusion having a generally trapezoidal contour in cross-section when the base 13 is formed by a drawing process, for example while the pair of second opposed journal bearing portions 13C are formed in the form of a protrusion having a generally, semi-circular contour in cross-section when the base 13 is formed by a drawing process (FIG. 1).

A pair of links 14 and 15 comprising a pantograph mechanism 24 is disposed on the membrane sheet 12 for each of the sets of the contact patterns with the pair of links 14 and 15 supported at their one ends in the associated journal bearing portions 13B and 13C, respectively.

As shown in FIGS. 3A and 3B, the first link 14 is generally U-shaped and comprises a shaft 14A and a pair of legs 14B extending from the shaft at the opposite ends thereof and having stud shafts 14C protruding outwardly therefrom at their forward ends and away from each other. The legs 14B further have columnar (solid cylindrical) bosses 14D protruding inwardly toward each other from the inside surfaces thereof intermediate their opposite ends. In addition, the legs 14B have stops 14E protruding inwardly toward each other from the inside surfaces thereof adjacent their forward ends.

The second link 15, as shown in FIGS. 4A and 4B, comprises a generally annular frame-like portion 1 5A having a pair of spaced apart extensions 15B extending in the same direction from the outer periphery of the frame-like portion along one semi-circular segment (forward end side) thereof. The two extensions 15B have stud shafts 15C extending inwardly toward each other therefrom adjacent the forward ends thereof. Further, a pair of stud shafts 15D extend outwardly from the base end portion (the other semi-circular segment) of the frame-like portion 15A in parallel to the stud shafts 15C. The frame-like portion 15A is formed in the diametrically opposed outside surfaces in the center thereof with shaft receiving holes 15E, respectively. The first and second links 14, 15 are typically made as molded parts of synthetic resin such as polyacetal (POM).

As shown in FIG. 2, the links 14 and 15 are configured such that the frame-like portion 15A of the link 15 is accommodated between the opposed legs 14B of the link 14 with the inside surfaces of the legs 14B facing the outside surfaces of the frame-like portion 15A and with the pair of bosses 14D matingly engaged in the corresponding holes 15E of the link 15 whereby the two links 14 and 15 are assembled and connected together for relative pivotal movement. It should be noted here that the stops 14E provided on the link 14 serve to limit the relative movement of the links 14 and 15 toward the overlapping relation beyond a predetermined position.

Prior to superposing the membrane sheet 12 over the base 13, the pair of stud shafts 14C of the link 14 are inserted in the corresponding journal bearing portions 13B of the base 13 from the membrane sheet 12 side to be rotatably and movably (slidably) supported therein, while the pair of stud shafts 15D of the link 15 are likewise inserted in the corresponding journal bearing portions 13C of the base 13 to be rotatably supported therein.

On the other hand, the shaft 14A of the link 14 is rotatably fitted in a pair of journal bearings 16A formed in the bottom side of the keytop 16 while the pair of stud shafts 15C of the link 15 are rotatably and slidably supported in corresponding slide bearings 16B formed in the bottom side of the keytop 16.

A dome-like rubber member 17 is mounted on the membrane sheet 12 within the opening 13A in the base 13 and extends through the central aperture of the frame-like portion 15A so as to be is interposed between the keytop 16 and the membrane sheet 12. The rubber member 17 comprises a cylindrical portion 17A fitted over a projection 16C extending from the keytop 16, and a dome portion 1 7B connecting with the cylindrical portion. The dome portion 17B has a push-button portion 17C projecting inwardly from the ceiling thereof for pressing down on the corresponding contact region of the membrane sheet 12.

With the keyboard switch constructed as described above, downward pressing operation on the keytop 16 will move the keytop 16 generally parallel to the face of the base 13 by means of the links 14 and 15 in the form of the pantograph mechanism while the keytop 16 presses on the rubber member 17 so that the dome portion 17B is deformed and collapsed down. Through this process, the user will get a good tactile feeling while at the same time the contact region of the membrane sheet 12 is pressed on by the push-button portion 17C whereby the electrical continuity is established. On the contrary, upon the downward pressure on the keytop being released, the rubber member 17 returns to its original position by its resilient restoring force to cut off the electrical continuity through the contact region whereby the keytop 16 is restored to its original position.

It should be noted here that an increasing reduction in the thickness of the keyboard switch of the type discussed herein is accompanied with a reduction in component space allowed to be allotted for the pantograph mechanism (linkage), inevitably leading to an increasing demand for reduction in both size and vertical profile (thickness) of the pantograph mechanism. Such a situation has resulted in a decrease in the rigidity of the linkage, and hence a greater vulnerability of the linkage to deformation.

More specifically, comparison between the links 14 and 15 has shown that the U-shaped link 14 is more vulnerable to deformation than the link 15 comprising the frame-like portion 15A as a central body portion. Moreover, there is more freedom of motion involved in the support of the stud shafts 14C provided at the forward ends of the legs 14B of the link 14 by the journal bearing portions 13B of the base 13 than in the support of the stud shafts 15D of the link 15 by the journal bearing portions 13C of the base 13. For this reason, when a force to pull the keytop 16 upward from its unactuated state is applied to the keytop as in an attempt to remove dust, for instance, such a situation may occur that the link 14 is pulled up together with the keytop 16 so that the forward ends of the legs 14B are deformed inwardly toward each other as shown by arrows 18 in FIG. 2 with the result that the stud shafts 14C are dislodged from the journal bearing portions 13B, and hence the link 14 is detached from the base 13.

Should such situation occur, common users using such keyboard would be unable to repair it by themselves, so that they would have to ask servicemen for repairs. In this regard, occurrence of link detachment has been hitherto a serious trouble.

Accordingly, an object of this invention is to provide a keyboard switch configured such that even a force applied on a keytop tending to pull it up may not possibly uncouple the associated link from the base.

SUMMARY OF THE INVENTION

According to this invention, a keyboard switch is provided which comprises a pantograph mechanism comprising a U-shaped first link having opposed legs and a second link including a frame-like portion embraced between the opposed legs of the first link, the opposed legs having first stud shafts protruding outwardly therefrom at their forward ends and away from each other, the first stud shafts being rotatably and movably supported in first bearing portions formed. on the base, the frame-like portion of the second link having second stud shafts extending outwardly therefrom at the base end portion thereof, the second stud shafts being inserted and rotatably supported in second bearing portions formed on the base, one of the inside surfaces of the opposed legs and the opposed outside surfaces of the frame-like portion opposing the corresponding inside surfaces of the legs having a pair of bosses protruding therefrom, the bosses being engaged in a pair of shaft receiving holes formed in the other of the inside surfaces of the opposed legs and the opposed outside surfaces of the frame-like portion, respectively to form the pantograph mechanism; a keytop supported by the first and second links; a membrane sheet (contact sheet) disposed on the side of the base opposite from the keyboard and having contact patterns formed thereon; and an actuating member operative in response to vertically downward and upward movements of the keytop relative to the membrane sheet to turn the contact patterns on and off, wherein projection means is formed on one of the inner sides of the opposed legs and the opposed outer sides of the frame-like portion and depression means for accommodating the projection means is formed in the other of the inner sides of the opposed legs and the opposed outer sides of the frame-like portion, one of the projection means and the depression means being formed with tapered surfaces, the arrangement being such that with the keytop in its unactuated position, the tapered surfaces on the one of the projection means and the depression means and angular edges of the other of projection means and the depression means are in abutment with or close to each other, and the tapered surfaces and the angular edges are forced into contact with each other when the keytop is pulled up from its unactuated position away from the membrane sheet, which urging force in turn urges the opposed legs to move such that their forward ends are forcedly expanded apart from each other.

DETAILED DESCRIPTION OF THE EMBODIMENTS OF THE INVENTION

Figure 1:
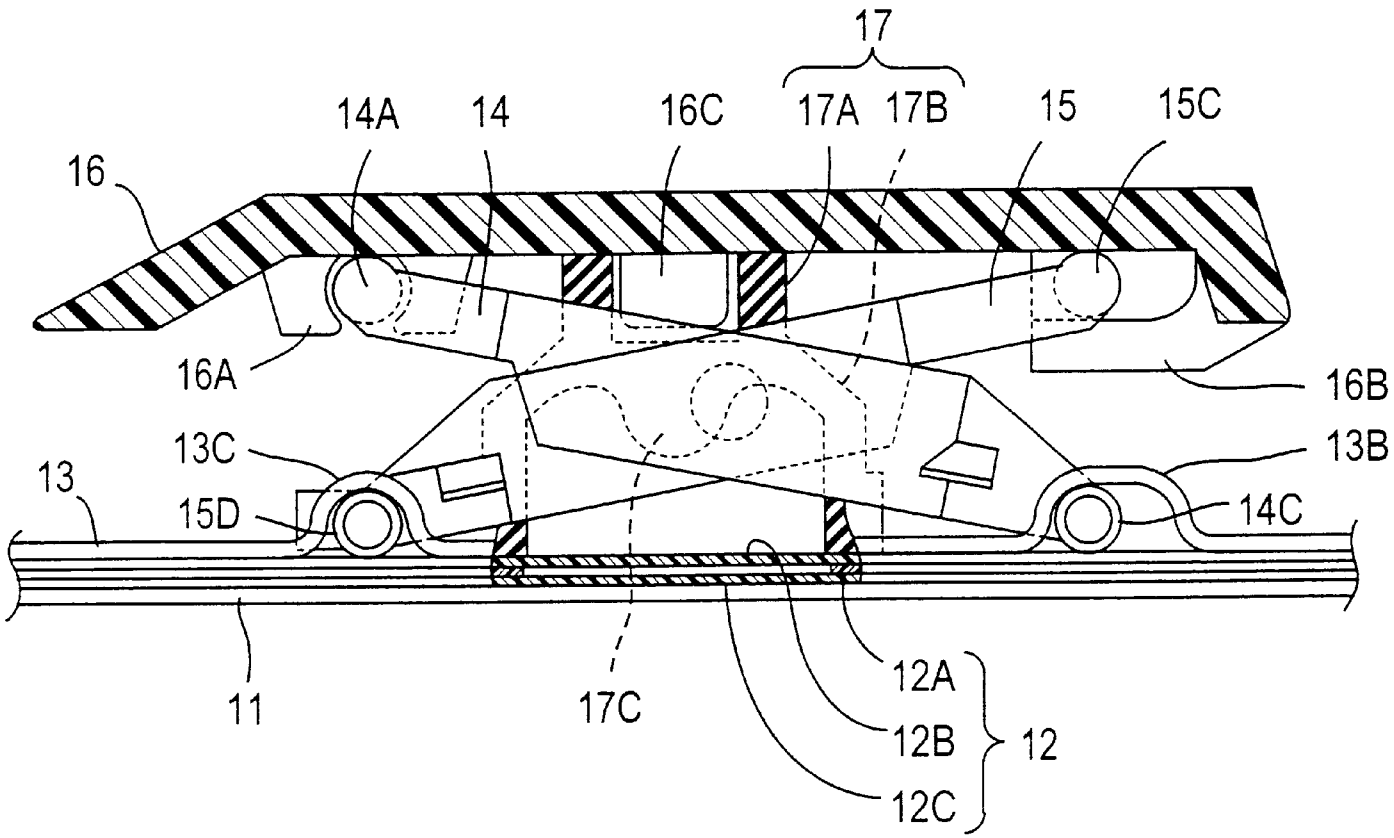
PRIOR ART FIG. 1
FIG. 1 is a cross-sectional view illustrating an example of the heretofore proposed keyboard switch.
Figure 2:
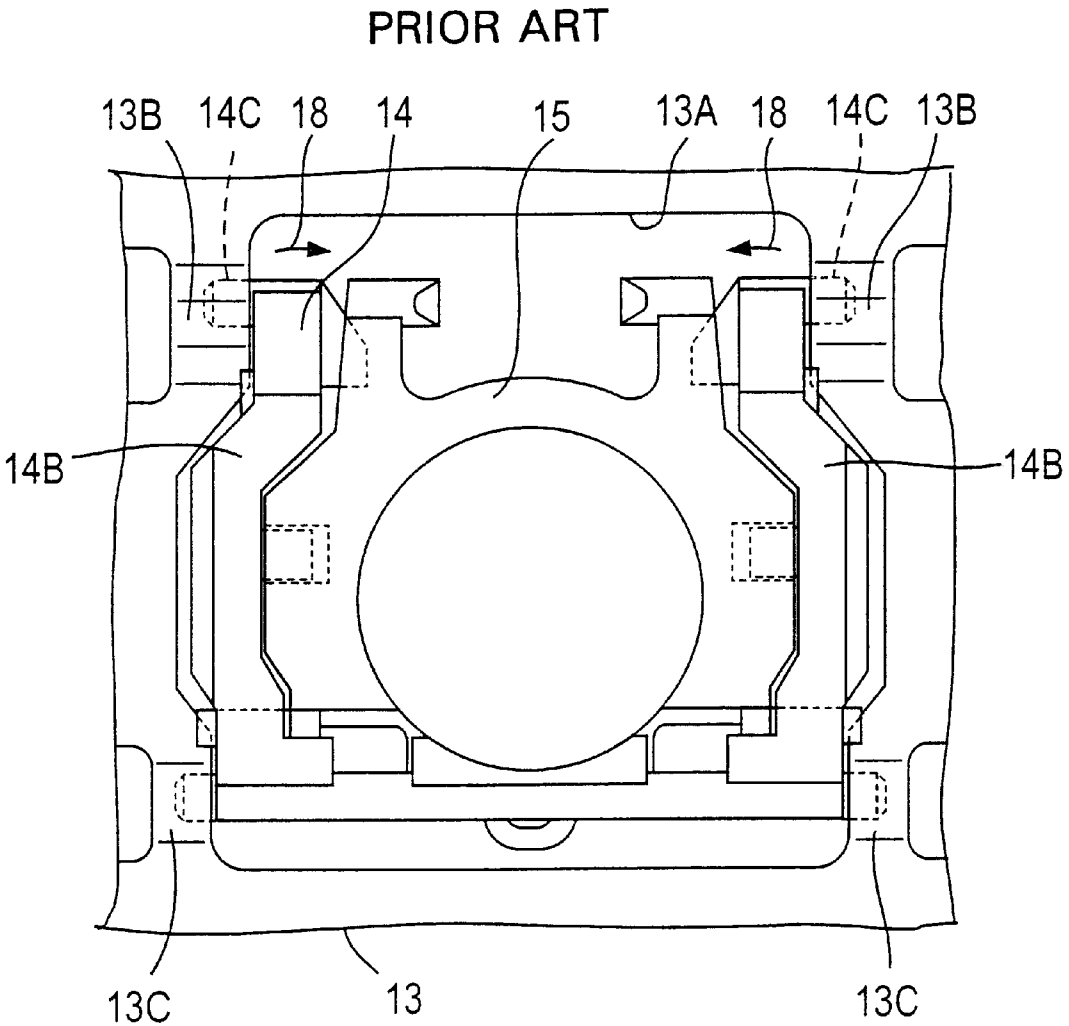
FIG. 2 is a partial breakaway plan view of the keyboard switch shown in FIG. 1.
Figure 3B:
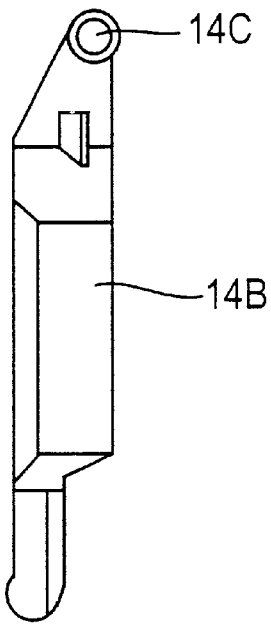
FIG. 3B PRIOR ART
FIG. 3B is a side view of the link 14 of FIG. 3A viewed from the right side thereof.
Figure 3A:
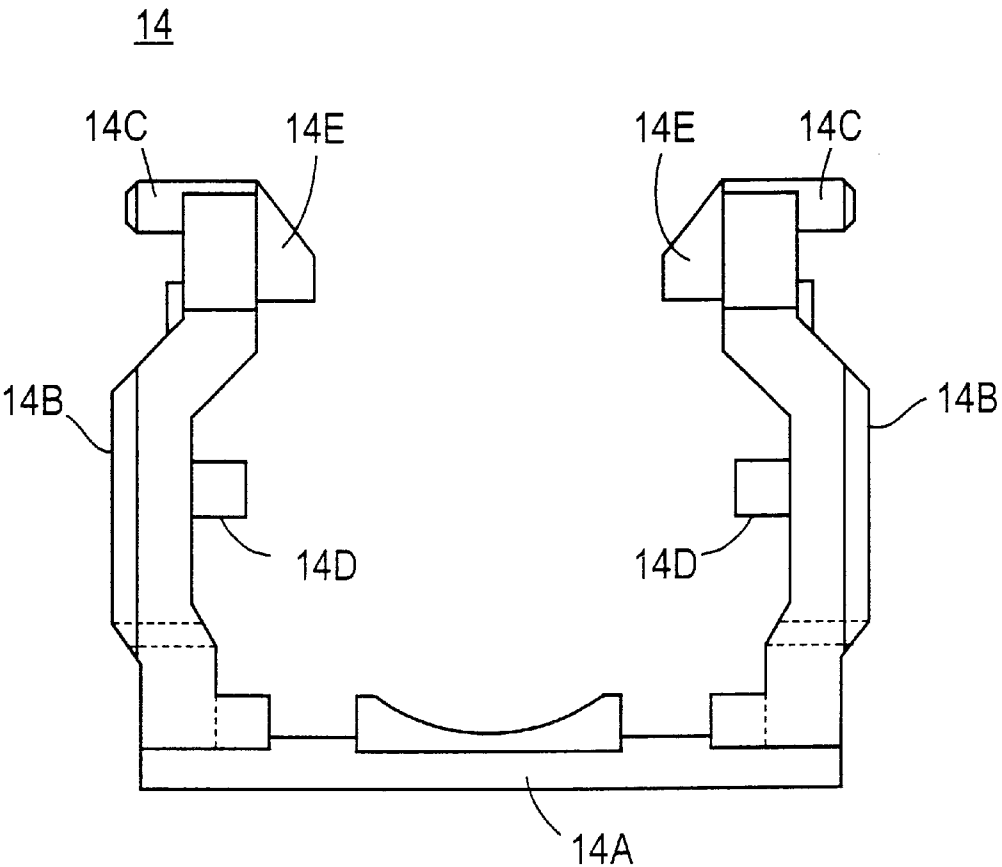
FIG. 3A PRIOR ART
FIG. 3A is a plan view of the link 14 shown in FIG. 1.
Figure 4B:
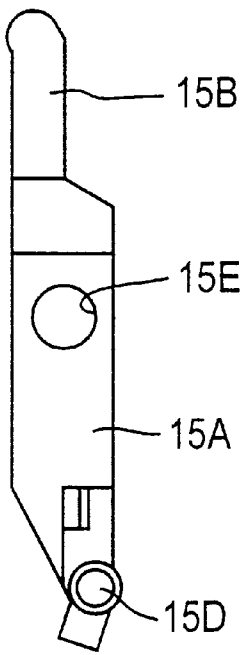
FIG. 4B PRIOR ART
FIG. 4B is a side view of the link 15 of FIG. 4A viewed from the right side thereof.
Figure 4A:
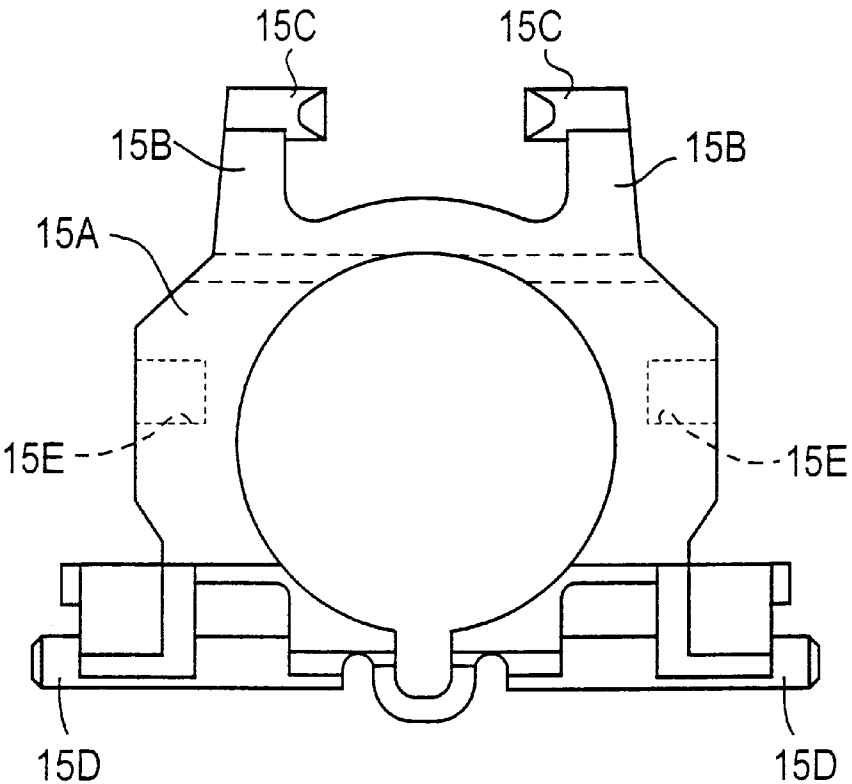
FIG. 4A PRIOR ART
FIG. 4A is a plan view of the link 15 shown in FIG. 1.

The embodiments of this invention will now be described with reference to the accompanying drawings. In the drawings subsequent to FIGS. 1–4, the parts that correspond to those parts in FIGS. 1–4 are indicated by like reference numerals and will not be discussed again.

Figure 5A:
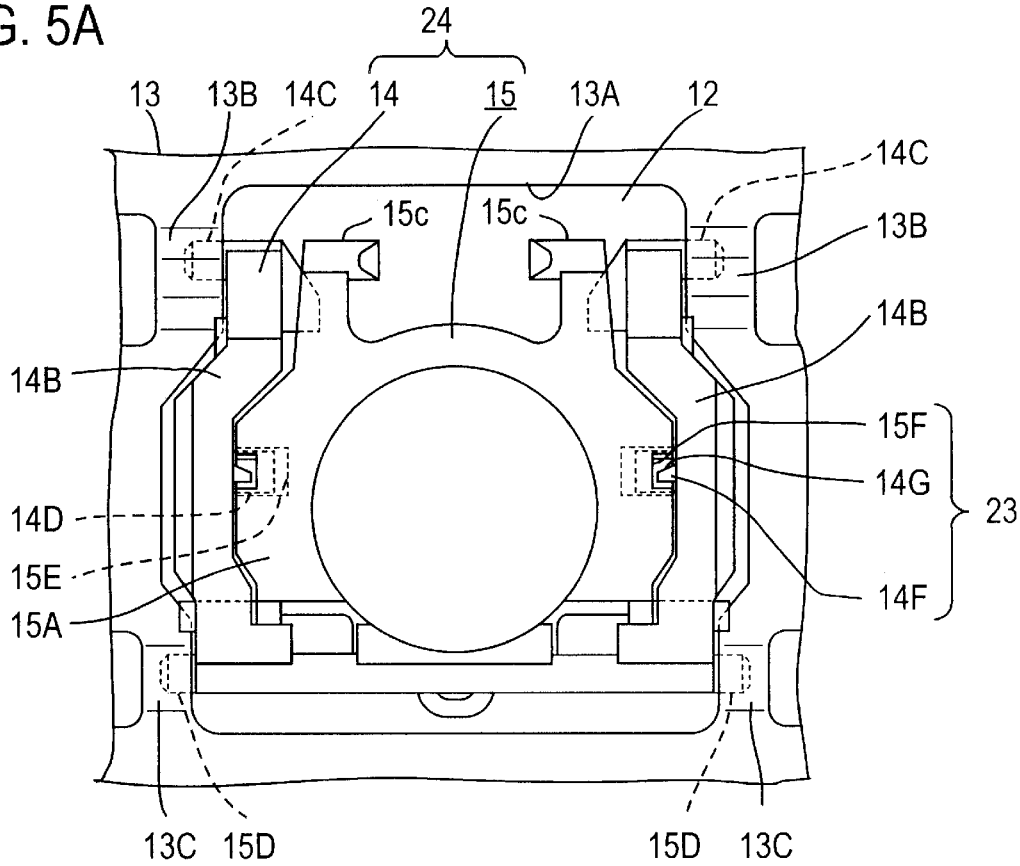
FIG. 5A is a partial breakaway plan view of the keyboard switch illustrating an embodiment of this invention with the keytop being pressed down.
Figure 5B:
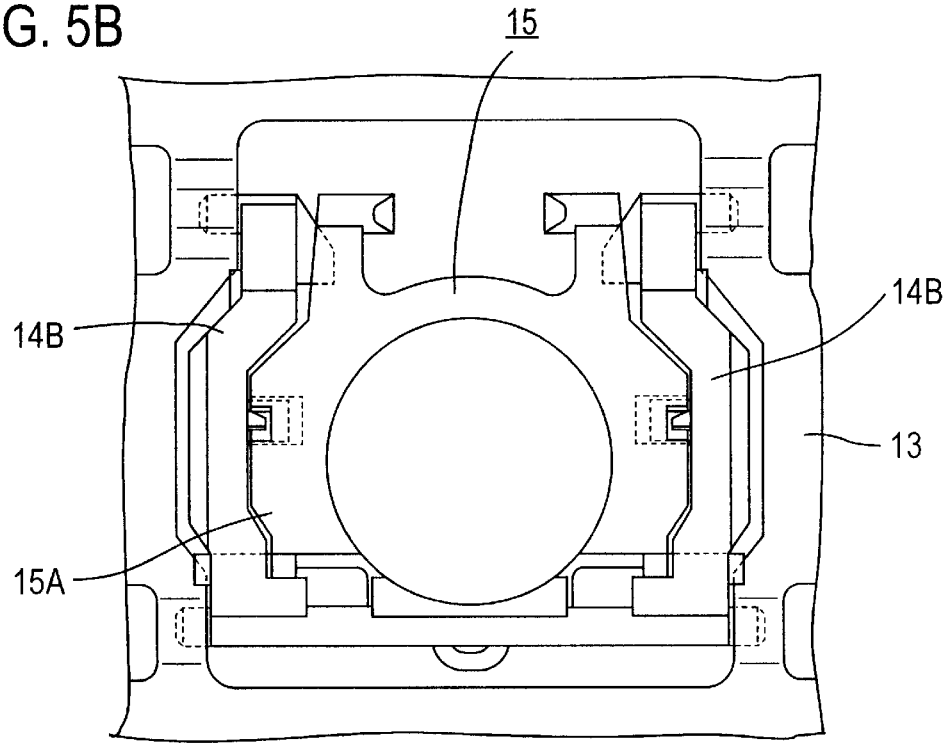
FIG. 5B is a plan view of the keyboard switch of FIG. 5A with the keytop being restored to its home position.

FIG. 5 illustrates the principal parts of an embodiment of this invention. Like the prior art keyboard switch shown in FIG. 1, the keyboard switch in this embodiment comprises a plate 11, a membrane sheet (contact sheet) 12, a base 13, and links 14 and 15, and further comprises a keytop 16 and a rubber member 17, neither of which is shown. It is to be noted that FIG. 5A illustrates what the keyboard switch is when its keytop is pressed down while FIG. 5B illustrates what the keyboard switch is when its keytop has been restored to its home position (unactuated state).

Figure 6B:
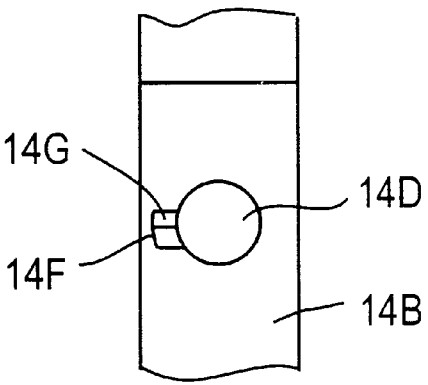
FIG. 6B is an enlarged view of the link as viewed in the direction indicated by arrows VI—VI in FIG. 6A.
Figure 6A:
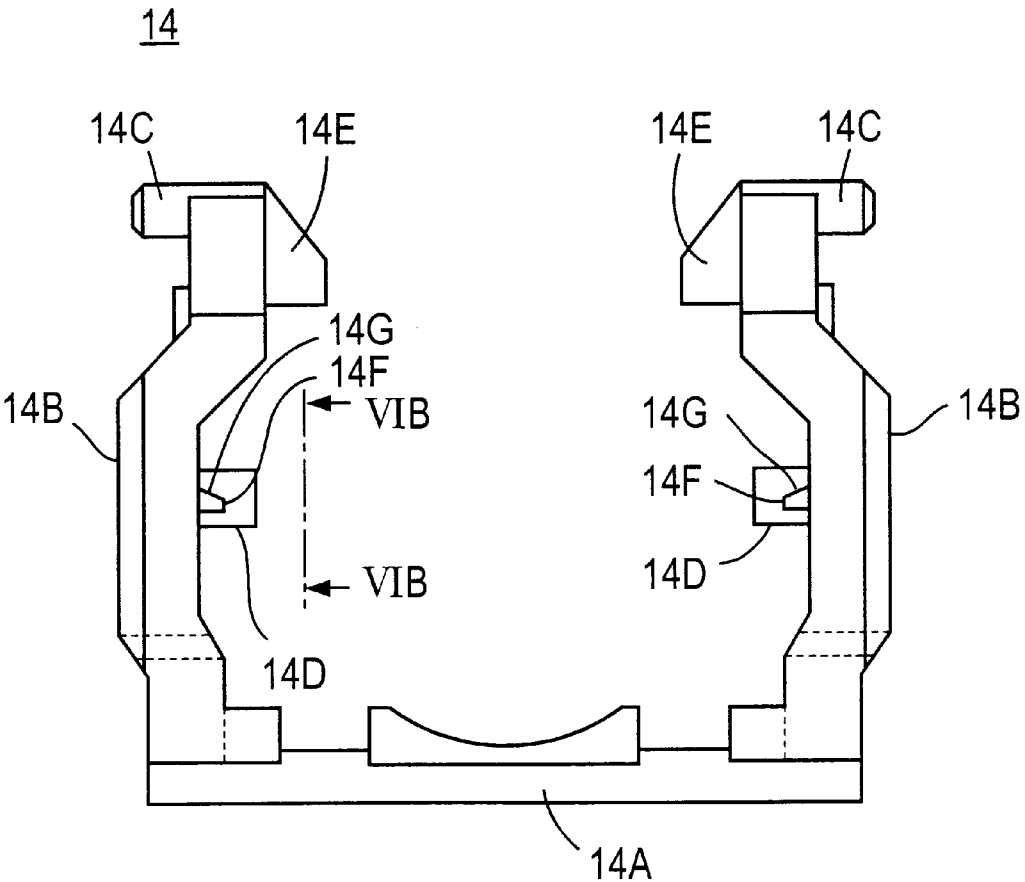
FIG. 6A is a plan view of the link 14 shown in FIG. 5.

FIG. 6 illustrates the construction of the link 14 in FIG. 5. The embodiment illustrated in FIGS. 5 and 6 is an instance in which the opposed legs 14B are provided on their inside surfaces with opposing male projections. In this example, each of the male projections comprises a rib or key 14F projecting from the outer periphery of the associated boss 14D (described hereinbefore with reference to FIGS. 3A and 3B) provided on each of the opposed legs 14B of the link 14. Each rib or key 14F extends axially halfway along the boss 14D starting from the root end thereof adjacent the leg 14B and is formed along one side thereof toward the forward end of the leg 14B with a tapered surface 14G which is inclined toward the forward end of the leg 14B as it nears the inside surface of the leg 14B as seen in FIG. 6A.

Figure 7B:
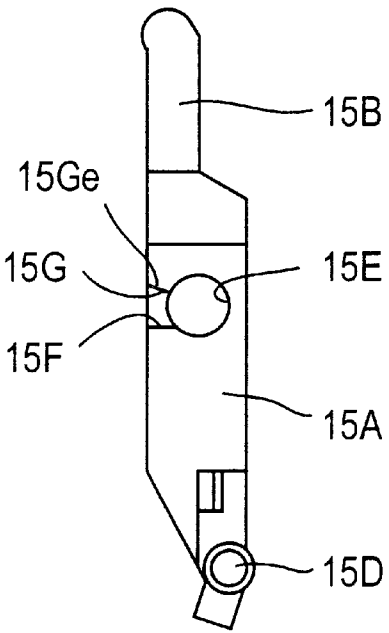
FIG. 7B is a side view of the link of FIG. 7A viewed from the right side thereof.
Figure 7A:
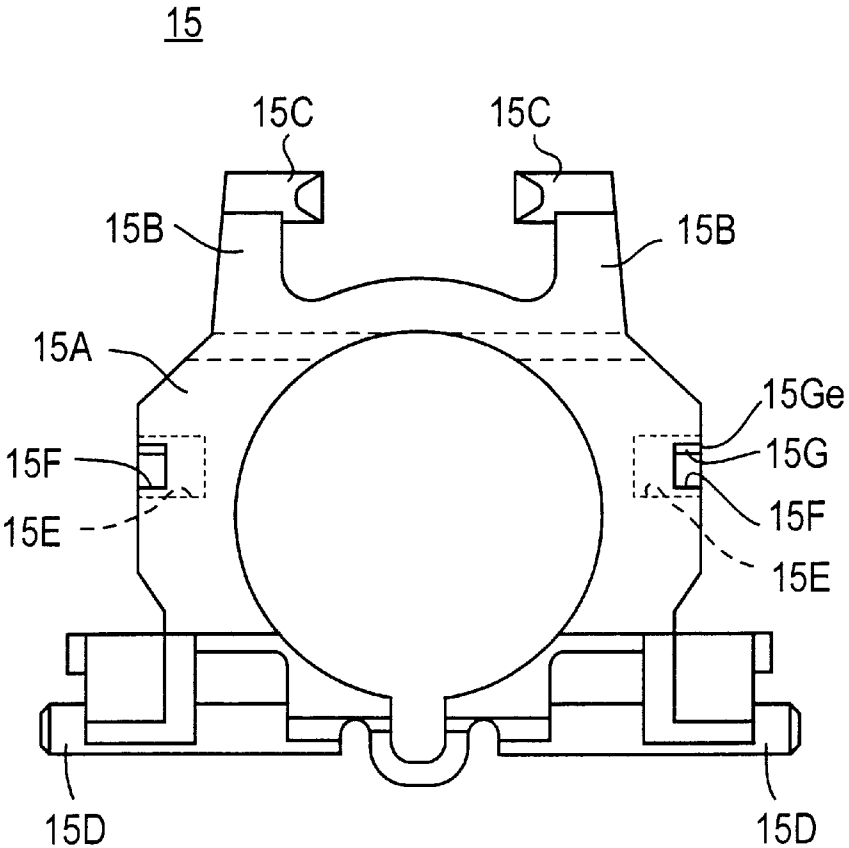
FIG. 7A is a plan view of the link 15 shown in FIG. 5.

On the other hand, as shown in FIG. 7, the link 15 is provided with keyways 15F as female depressions for accommodating the corresponding ribs or keys 14F as male projections. The keyways 15F are formed in the inner peripheral walls of the pair of diametrically opposed holes 15E (described hereinbefore with reference to FIGS. 4A and 4B) provided in the frame-like portion 15A of the link 15. In this example, each of the keyways 15F is formed by making a cutout in the outer surface of the frame-like portion 15A so as to intersect with the corresponding hole 14E as seen in FIGS. 7A and 7B. It should also be noted that one side inner wall 15G of each keyway 15F toward the corresponding stud shaft 15C is inclined or tapered so as to point generally toward the center of the hole 15E.

The pair of ribs 14F provided in the link 14 and the pair of keyways 15F provided in the link 15 are located in such angular positions with respect to the central axes of the corresponding bosses 14D and the central axes of the corresponding holes 15E that the ribs 14F are accommodated in the corresponding keyways 15F as shown in FIG. 5A when the links 14 and 15 are assembled together by the bosses 14D being engaged in the holes 15E.

It is here to be noted that the pair of stud shafts 14C of the link 14 and the pair of stud shafts 15D are supported in the journal bearing portions 13B and the journal bearing portions 13C, respectively formed in the base 13 as is the case with the prior art.

Figure 8A:
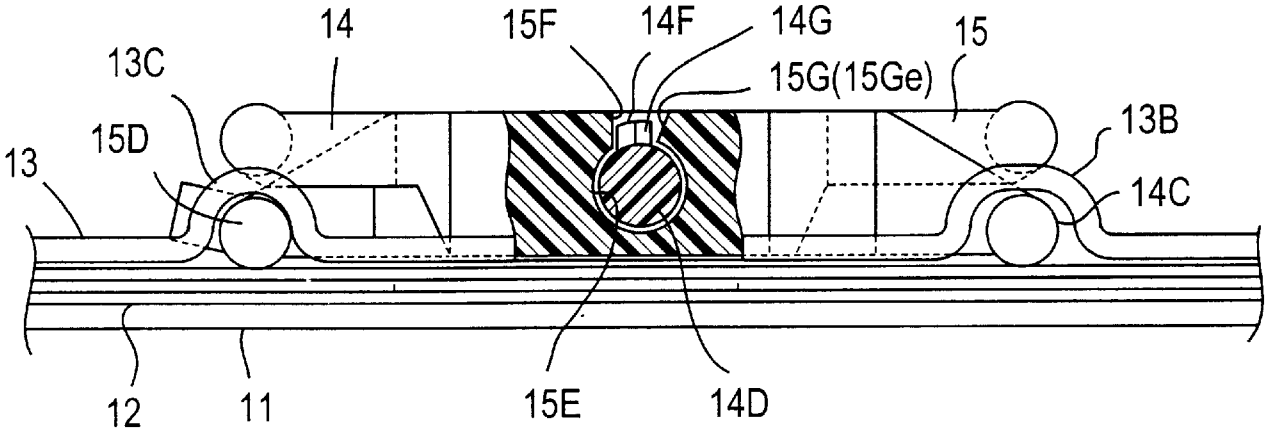
FIG. 8A is a side view, partly in cross-section, corresponding to FIG. 5A illustrating the keyboard switch with its keytop being pressed down.
Figure 8B:
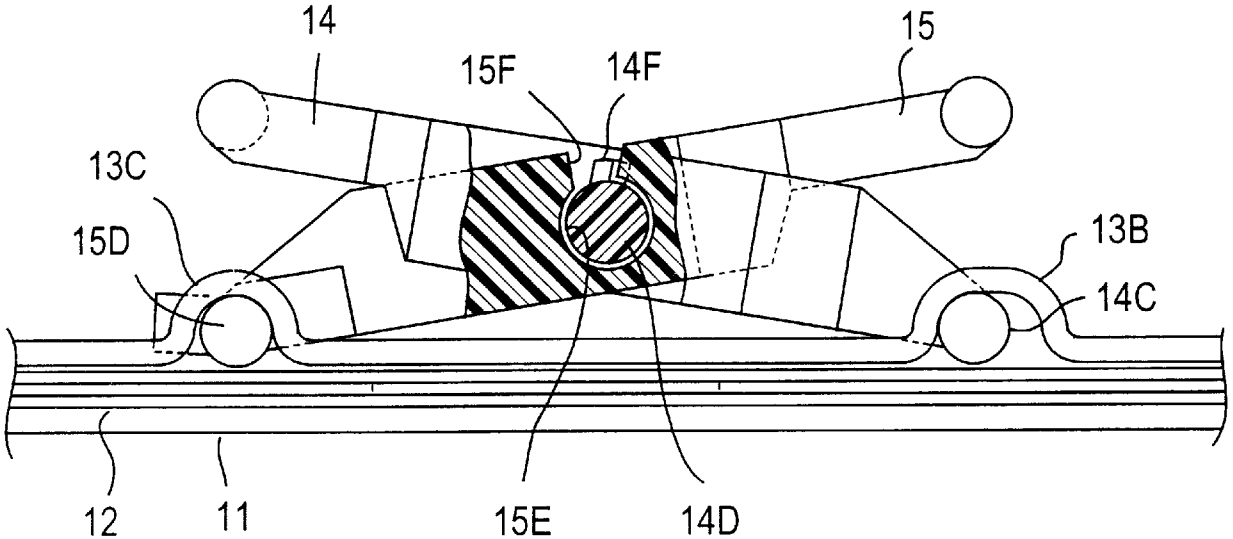
FIG. 8B is a view corresponding to FIG. 5B illustrating the keyboard switch with its keytop being restored to its home position.

With the keytop 16 in its depressed (actuated) state, the tapered surface 14G of the rib 14F is simply received in the keyway 15F provided in the link 15 but not in abutment with the inside surface of the keyway 15F, as shown in FIG. 5A. In contrast, with the keytop 16 restored to its original or home position (unactuated state), the tapered surface 14G of the rib 14F and the outside angular edge or corner 15G*e* of the tapered surface 15G of the keyway 15F are in abutment with or very close to each other, as shown in FIG. 5B. FIGS. 8A and 8B are side views, partly in cross-section, corresponding to FIGS. 5A and 5B, respectively illustrating the keytop being in its depressed position and in its original position. It is seen that in FIG. 8A the tapered surface 14G of the rib 14F is not in touch with the tapered surface 15G of the keyway 15F whereas in FIG. 8B the tapered surface 14G of the rib 14F and the angular edge 15G*e* of the tapered surface 15G of the keyway 15F are in contact with or very close to each other.

Figure 9:
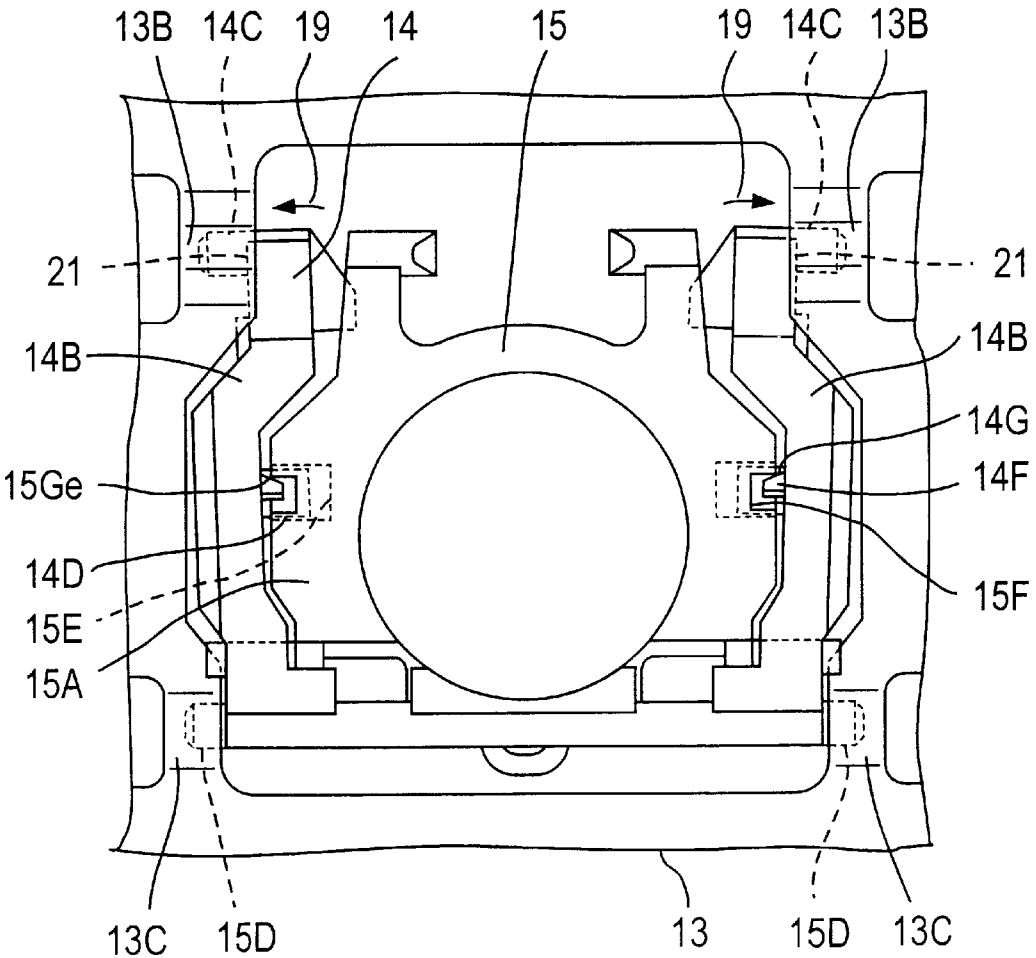
FIG. 9 is a plan view illustrating the keyboard switch with the keytop being pulled up further from the home position.

FIG. 9 illustrates what the links 14 and 15 are when the keytop 16 is pulled up further away from its original position. Specifically, as the links 14, 15 are rotated, the tapered surface 14G of the rib 1 4F and the angular edge 15G*e* of the keyway 15F are forced into contact with each other. This urging force in turn urges the opposed legs 14B of the link 14 to move such that their forward ends are forcedly expanded apart from each other as indicated by arrows 19 in the drawing until the opposed legs 14B would be urged to the positions shown by broken lines 21 unless the movement were limited by the corresponding edges of the opening 13A in the base 13.

More specifically, the tapered surfaces 14G of the ribs 14F are inclined toward the forward ends of the legs 14B as they near the inside surfaces of the legs 14B as described above, so that in this embodiment the rotation of the links 14, 15 is utilized to produce a force tending to prevent the dislodgement of the link 14. That is, as the force tending to pull up the keytop is greater, the urging force to bring the tapered surfaces 14G of the ribs 14F and the angular edges 15G*e* of the keyways 15F into contact with each other is progressively increased and hence the forward ends of the opposed legs 14B of the link 14 are forcedly expanded further apart from each other in the direction of the arrows 19. Accordingly, even if a force to pull the keytop upward, for example is exerted on the keytop, there would be no possibility of the stud shafts 14C of the link 14 being dislodged from the journal bearing portions 13B of the base 13, as would be the case with the prior art.

Figure 10A:
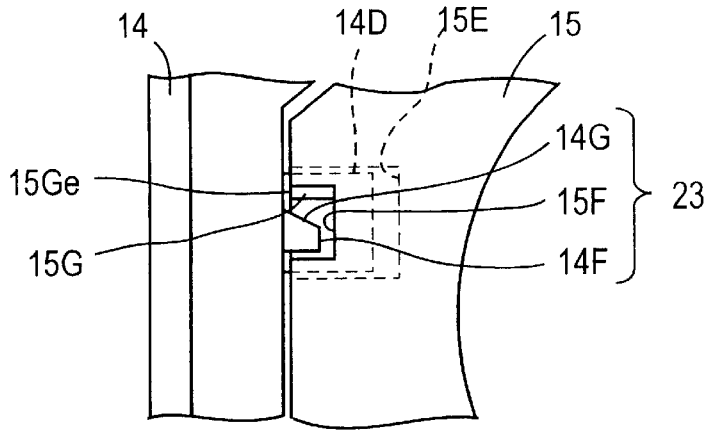
FIGS. 10A, 10B and 10C are enlarged fragmentary views illustrating the leg dislodgement preventing means 23 shown in FIGS. 5A, 5B and 9, respectively.
Figure 10B:
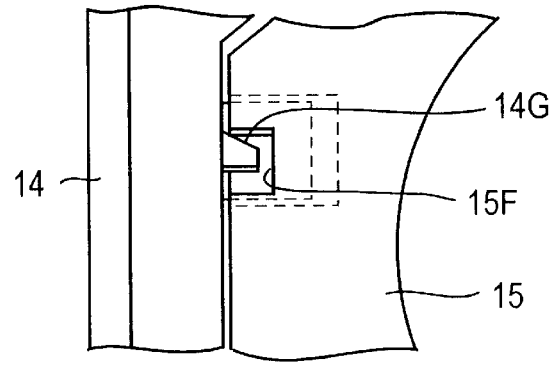
Figure 10C:
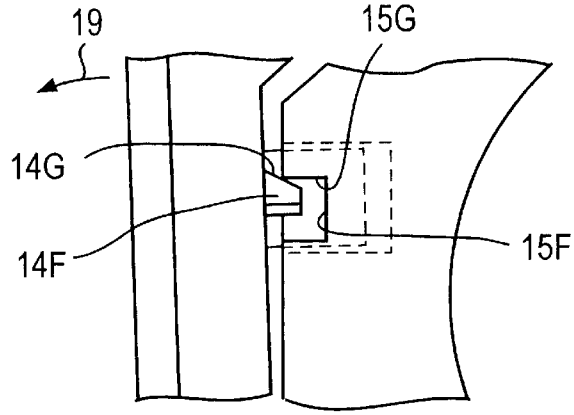

FIGS. 10A, 10B and 10C illustrate in enlarged views the relationship between the ribs 14F and the keyways 15F when the keytop 16 is in its depressed position, in its original position, and in a position pulled up beyond its original position, respectively. In the position of FIG. 10A, the tapered surface 14G is not in touch with the wall of the keyway 15F, but in the position of FIG. 10B, the tapered surface 14G and the tapered surface 15G of the keyway 15F are in abutment with each other approximately in parallelism. In FIG. 10C, the tapered surface 14G and the exterior edge 15 G*e* (the angular edge on the side surface of the frame-like portion 15A) of the tapered surface 15G of the keyway 15F are in line pressure contact with each other.

In other words, the rib 14F as a male projection having the tapered surface 14G and the keyway 15F as a female depression comprise one form of the leg dislodgement preventing means 23.

Alternatively, instead of:being tapered, the one side surface 15G of the keyway 15F may be square, that is, parallel to the direction of projection of the rib 14F when the keytop 16 is in its depressed position (FIG. 8A). In this instance, however, with the keytop in its pulled-up condition (FIG. 9 and 10C), the tapered surface 14G of the rib 14F will make point contact with the angular edge 15G*e* of the keyway 15F, so that the load on the rib 14F is concentrated on the point with some possibility of breakage of the rib 14F. However, in the case where line contact is made between the tapered surface 14G of the rib 14F and the angular edge 15G*e* of the keyway 15F as in the embodiment illustrated, the concentration of the load is reduced with correspondingly less likelihood of breakage of the rib 14F.

The embodiment illustrated introduces another advantage that the provision of the ribs 14F protruded from the peripheries of the bosses 14D defining the center of rotation for the pantograph mechanism permits the assembly of the links 14 and 15 only in one orientation, that is, prevents the reverse assembly.

Figure 11:
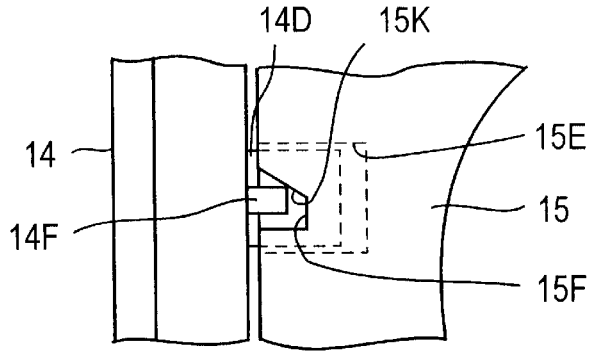
FIG. 11 is a view similar to that of FIG. 10B but illustrating a modified form of the leg dislodgement preventing means 23 shown in FIG. 5.

While in the embodiment described above each of the ribs 14F is provided with the tapered surface 14G in order to produce a force for forcedly expanding the opposed legs 14 of the link 14 apart from each other, the rib 14F may be provided with no such tapered surface, but instead each of the keyways 15F may be provided with a tapered surface 15K which is inclined toward the forward end of the link 15 as it nears the outside surface of the link 15 as shown in FIG. 11 which diagrammatically illustrates the keytop 16 in its pulled-up condition (corresponding to FIG. 10C). In this case, when the keytop is pulled up too far, the angular edge of the rib 14F is forced into contact with the tapered surface 15K to forcedly expand the opposed legs 14 of the link 14.

In the construction of the linkage of the embodiment illustrated the opposed legs 14B of the U-shaped link 14 are provided with the bosses 14D whereas the frame-like portion 15A of the link 15 is formed with the holes 15E for engaging with the bosses 14D. However, it will be appreciated that in the linkage configuration in which the bosses are provided on the link 15 whereas the boss receiving holes are formed in the link 14 as well, the ribs and keyways may be arranged in the manner similar to that described above to provide equally effective functions.

Another embodiment of this invention will next be described with reference to FIGS. 12–14.

In this embodiment, male projections and female depressions serving to forcedly expand the opposed legs 14B of the link 14 as in the first embodiment are provided on the inside surfaces of the opposed legs 14B of the link 14 at a location other than the center of rotation of the pantograph mechanism (linkage) and on the outside surfaces of the frame-like portion 15A of the link 15 again at a location other than the center of rotation. The constructions of the male projections and female depressions of the links 14 and 15 will first be described.

Figure 12B:
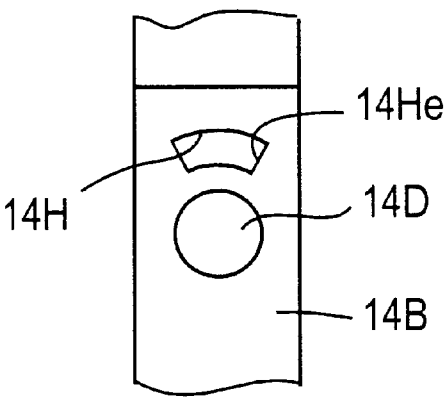
FIG. 12B is an enlarged view of the link as viewed in the direction indicated by arrows XIIB—XIIB in FIG. 12A.
Figure 12A:
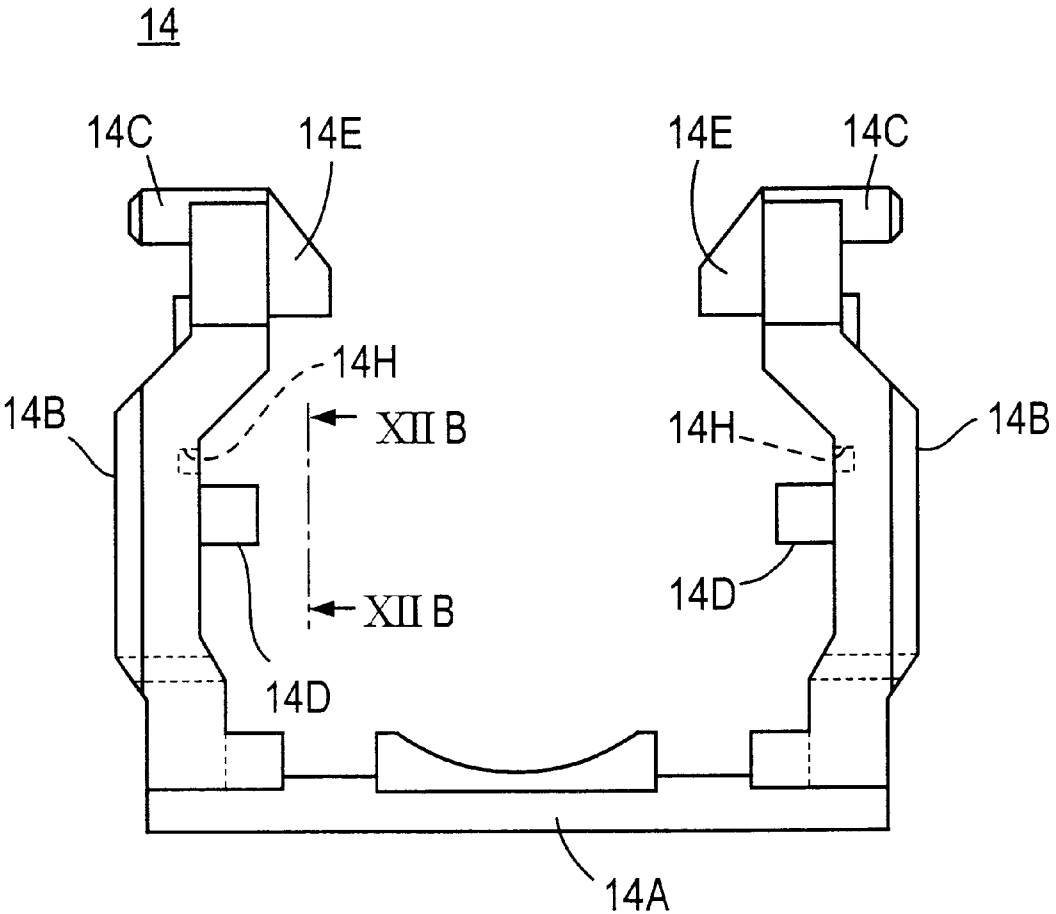
FIG. 12A is a plan view illustrating a link 14 for use in another embodiment of this invention.

In the link 14 in this example, the opposed legs 14B are formed in their opposed inside surfaces with female depressions 14H forward of the bosses 14D, as shown in FIGS. 12A and 12B. As best seen in FIG. 12B, each depression 14H is in the form of an arcuate slot concentric with the center of the corresponding boss 14D.

Figure 13B:
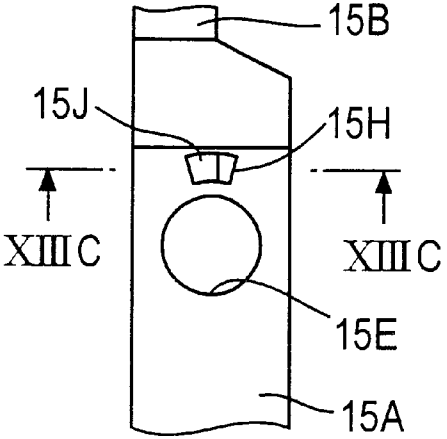
FIG. 13B is an enlarged fragmentary side view of the link in FIG. 13A as seen from the right side thereof.
Figure 13C:
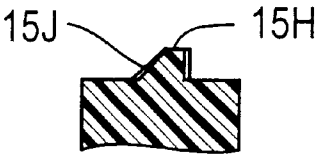
FIG. 13C is a partial cross-sectional view of the link in FIG. 13B taken along the line XIIIC—XIIIC.
Figure 13A:
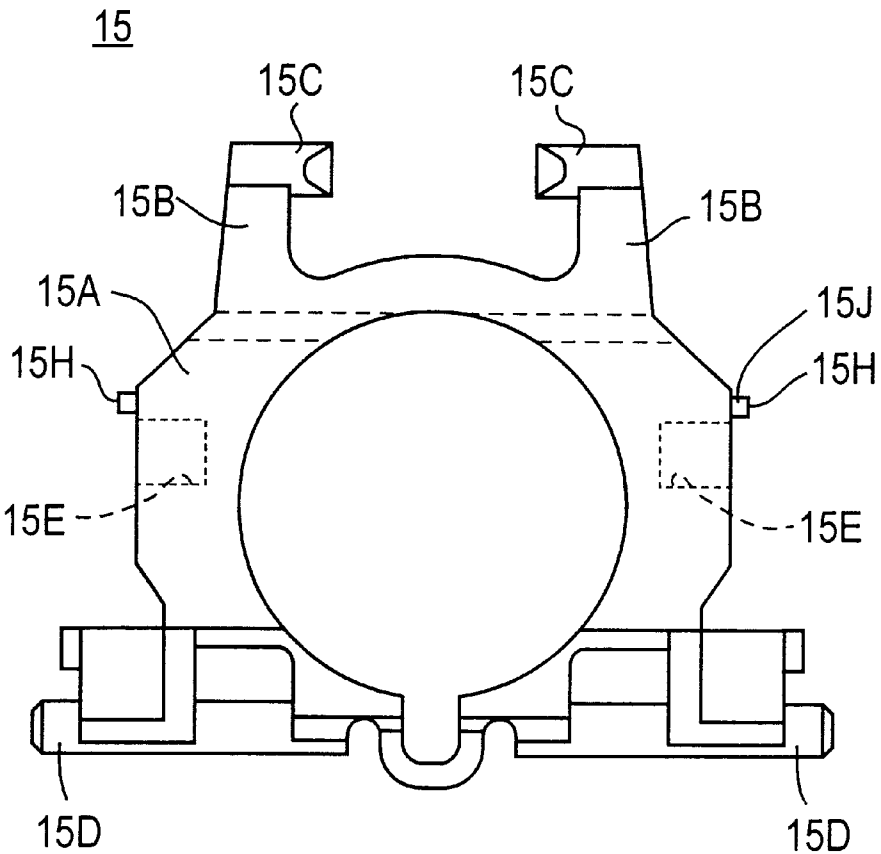
FIG. 13A is a plan view illustrating a link 15 for use in coordination with the link 14 of FIG. 12.

On the other hand, as shown in FIGS. 13A and 13B, the link 15 is provided with male projections 15H at locations corresponding to the depressions 14H. Each projection 15H is of an arcuate shape concentric with the center of the corresponding hole 15E and is formed on one of the opposed circumferential sides with a tapered surface 15J as shown in FIGS. 13B and 13C. The tapered surface 15J is formed on the side of the projection 15H toward the keytop 16 and is inclined toward the keytop as it nears the outer end of the projection 15H from its root. It should be noted that the circumferential length of the projection 15H including the tapered surface 15J is shorter by a predetermined amount that of the depression 14H.

Figure 14A:
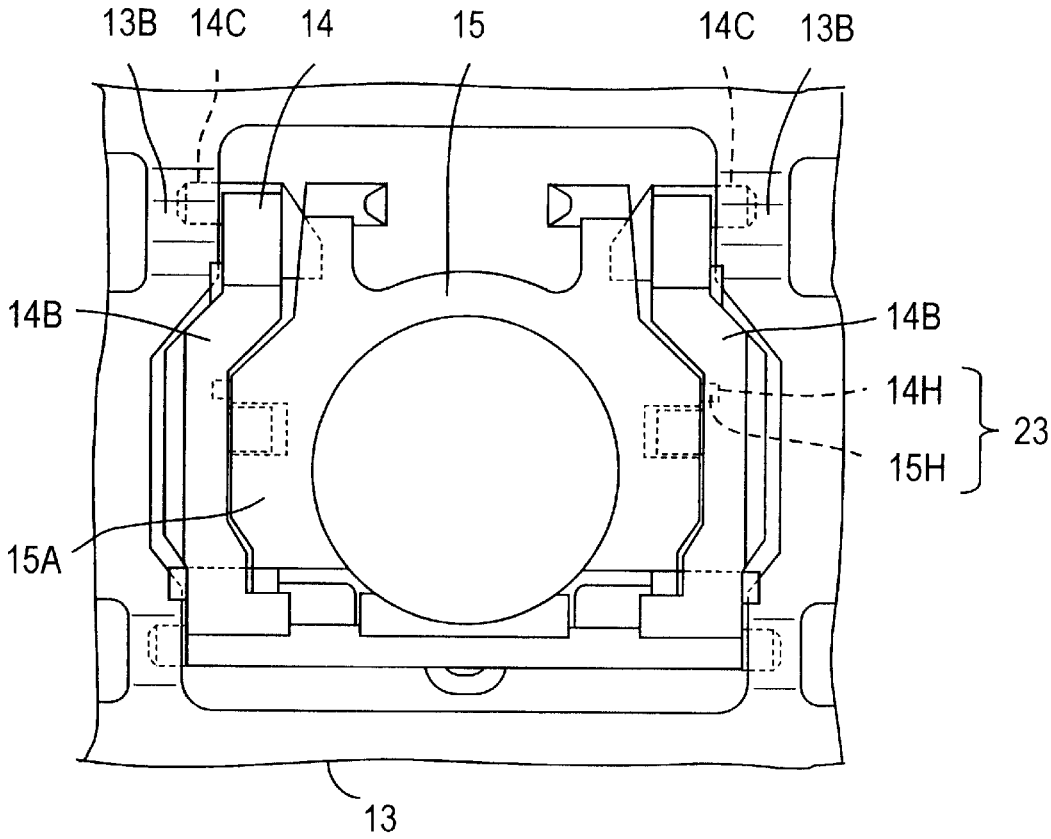
FIG. 14A is a plan view illustrating the link 14 in FIG. 12 and the link 15 in FIG. 13 being assembled together.
Figure 14B:
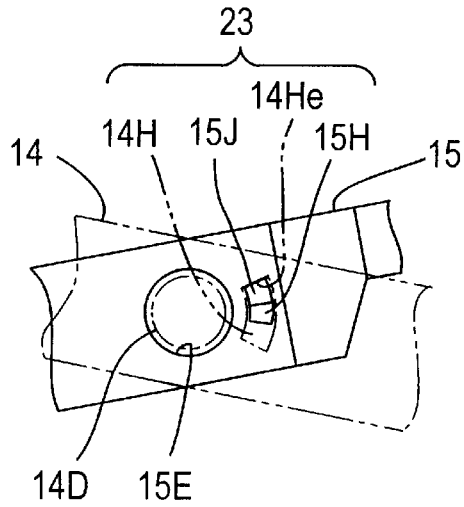
FIG. 14B is a view illustrating the leg dislodgement preventing means 23 shown in FIG. 14A.

FIG. 14A illustrates what the link 14 having the depressions 14H and the link 15 having the projections 15H when the links 14 and 15 are assembled together with the projections 15H being accommodated in the depressions 14H. With the keytop 16 in its original returned position (unactuated state), the depressions 14H and the projections 15H are in the positional relation shown in FIG. 14B in which the tapered surface 15J provided on each projection 15H is in abutment with or very close to the arcuate angular edge 14 H*e* of the associated depression 14H.

Consequently, when the keytop is pulled up further from this unactuated original position, the tapered surface 15J and the angular edge 14 H*e* of the depression 14H are forced into contact with each other. This urging force in turn urges the opposed legs 14B of the link 14 to move such that their forward ends are forcedly expanded apart from each other. It is thus to be appreciated that the combination of the depression 14H and the projection 15H is capable of accomplishing the function similar to that achieved by the mechanism comprising the rib 14F and the keyway 15F. In other words, the depression 14H, the projection 15H and the tapered surface 15J comprise another form of the leg dislodgement preventing means 23.

The depression 14H and the projection 15H need not necessarily be of an arcuate shape. It is essential only that there be virtually no contact between the depression 14H and the projection 15H during the normal key operation, but that when the keytop is pulled up further from its unactuated original position, the tapered surface 15J and the angular edge 14 H*e* of the depression 14H be forced into contact with each other to produce the urging force to forcedly expand the forward ends of the opposed legs 14B apart from each other.

In contrast to the embodiment described just above, the projections may be provided on the link 14 while the link 15 may be provided with the depressions. Further, instead of being provided on the projections, the tapered surfaces may be provided on the depressions. In addition, while in the example illustrated here the rubber member 17 is used to turn the contacts on the membrane sheet 12 on and off, it should be understood that the invention is not limited to the use of such rubber member All that is required is a resilient actuating member which is capable of turning the contacts on the membrane sheet 12 on when the keytop is pressed down and returning the keytop to its original position when the downward pressure on the keytop is released.

With regard to the membrane sheet, it may be a contact sheet comprising having a pair of contact patterns formed on an insulation sheet as disclosed in the Japanese Patent Laid Open Application No. 2000/288639. Specifically, the push-button portion 17C of the rubber member 17 comprises an electrically conducting member and the arrangement may be such that upon the keytop being pressed down, the conducting member is brought into contact with the pair of contact patterns to establish electrical connection between the contact patterns.

As discussed above, it will be appreciated that according to this invention, such a serious trouble as the links are dislodged from the journal bearing portions of the base may be prevented from occurring even if a force tending to pull the keytop upward.

What is claimed is:

1. A keyboard switch comprising:

a contact sheet having contact pattern means formed thereon;

a base disposed on said contact sheet and having an opening formed therethrough and a pair of first journal bearing portions and a pair of second journal bearing portions formed along two opposed side edges of said opening and projecting oppositely from said base sheet, said first bearing portions having a generally trapezoidal contour in cross-section and said second bearing portions having a generally semi-circular contour in cross-section;

a pantograph mechanism comprising a U-shaped first link having opposed legs and a second link including a frame portion embraced between said opposed legs of the first link, both links being disposed on said base, said opposed legs having first stud shafts protruding outwardly therefrom at their forward ends and away from each other, said first stud shafts being rotatably and movably supported in the pair of said first bearing portions, said frame portion of said second link having second stud shafts extending outwardly therefrom at the base end portion thereof, said second stud shafts being inserted and rotatably supported in a pair of said second bearing portions, said frame portion of said second link having third stud shafts extending inwardly toward each other therefrom adjacent the end thereof opposite from said base end portion, one of the inside surfaces of said opposed legs and the opposed outside surfaces of said frame portion opposing said corresponding inside surfaces of the legs having bosses protruding therefrom, said bosses being engaged in shaft receiving holes formed in the other of the inside surfaces of said opposed legs and the opposed outside surfaces of said frame portion, respectively, said first and second links being connected together for pivotal movement to form said pantograph mechanism;

a keytop disposed on said pantograph mechanism and rotatably supporting said U-shaped first link and rotatably and slidably supporting said pair of third stud shafts;

a resilient actuating member extending through said frame portion and interposed between said keytop and said contact membrane sheet and adapted to turn said contact patterns of the contact sheet on when the keytop is pressed down toward said contact sheet and to return the keytop to its original position when the downward pressure on the keytop is released; and a leg dislodgement preventing means comprising projection means formed on one of the inner sides of said opposed legs and the opposed outer sides of said frame portion and depression means for accommodating said projection means formed in the other of the inner sides of said opposed legs and the opposed outer sides of said frame portion, one of said projection means and the depression means being formed with tapered surfaces, wherein with said keytop in its unactuated position, said tapered surfaces and edges of the other of the projection means and the depression means are in contact with or very close to each other, and said tapered surfaces and said edges are forced into contact with each other when said keytop is moved from its unactuated position further away from said contact sheet.

2. The keyboard switch of claim 1 wherein said projection means is formed integrally with each of said bosses and said depression means is formed adjacent to each of said shaft receiving holes.

3. The keyboard switch of claim 2 wherein said bosses are provided on said opposed legs and said tapered surfaces are provided on said projection means, said tapered surfaces being inclined toward the forward ends of the corresponding legs as the tapered surfaces near the roots of the corresponding bosses from the end faces of the bosses on which said projection means is provided.

4. The keyboard switch of claim 2 wherein said tapered surfaces are on said projection means said edges are on said depression means, wherein said edges of said depression means with which said tapered surfaces are forced into contact are located on the outer side surface of said frame portion toward said corresponding third stud shafts of said second link, the surfaces of said depression means defining said edges being tapered so as to point toward the center of said corresponding shaft receiving holes.

5. The keyboard switch of claim 2 wherein said projection means and said depression means are located toward said keytop with respect to the center of each of said shaft receiving holes.

6. The keyboard switch of claim 1 wherein said projection means are formed on one of the inner side surfaces of said opposed legs and the opposed outer side surfaces of said frame portion and said depression means are formed in the other of the inner side surfaces of said opposed legs and the opposed outer side surfaces of said frame portion.

7. The keyboard switch of claim 6 wherein said tapered surfaces are formed on the sides of said corresponding depression means located toward said keytop and are inclined toward the keytop as the tapered surfaces near the projected outer ends of the corresponding projection means from the roots of the projection means, and said edges with which said tapered surfaces are forced into contact are the corner edges of the depression means on the side surface in which said depression means is formed and located toward said keytop.

8. The keyboard switch of claim 7 wherein said projection means and said depression means are positioned closer to the forward ends of said opposed legs than the center of rotation of said pantograph mechanism.

* * * * *